US009232876B2

(12) United States Patent
Bando et al.

(10) Patent No.: US 9,232,876 B2
(45) Date of Patent: Jan. 12, 2016

(54) PACKAGE STRUCTURE

(75) Inventors: Takeshi Bando, Kanonji (JP); Daisuke Miyake, Kanonji (JP); Ikue Hiramatsu, Kanonji (JP); Yoshihide Ishikawa, Kanonji (JP)

(73) Assignee: UNICHARM CORPORATION, Ehime-Ken (JP)

( * ) Notice: Subject to any disclaimer, the term of this patent is extended or adjusted under 35 U.S.C. 154(b) by 344 days.

(21) Appl. No.: 13/877,043

(22) PCT Filed: Sep. 16, 2011

(86) PCT No.: PCT/JP2011/071226

§ 371 (c)(1),
(2), (4) Date: Jun. 11, 2013

(87) PCT Pub. No.: WO2012/043278

PCT Pub. Date: Apr. 5, 2012

(65) Prior Publication Data

US 2013/0256169 A1 Oct. 3, 2013

(30) Foreign Application Priority Data

Sep. 30, 2010 (JP) ..... 2010-223248

(51) Int. Cl.
*A47K 7/00* (2006.01)
*B65B 25/14* (2006.01)
(Continued)

(52) U.S. Cl.
CPC ..... *A47K 7/00* (2013.01); *B65B 25/145* (2013.01); *B65B 35/50* (2013.01);
(Continued)

(58) Field of Classification Search
CPC ..... B65D 83/0894; B65D 83/08; B65D 83/0805; A47K 10/32; A47K 2010/3266; A47K 10/42; A47K 10/421; A47K 2010/428; B65B 25/145; B65H 45/24
USPC ..... 206/494, 233, 812, 449; 221/48, 49, 51
See application file for complete search history.

(56) References Cited

U.S. PATENT DOCUMENTS 2,477,223 A * 7/1949 West ..... 206/494
3,207,361 A * 9/1965 Marcalus ..... 221/48
(Continued)

FOREIGN PATENT DOCUMENTS

CN 1343477 A 4/2002
CN 1781819 A 6/2006
(Continued)

OTHER PUBLICATIONS

Office Action mailed Sep. 22, 2014, corresponding to Chinese patent application No. 201110304168.8.
(Continued)

*Primary Examiner* — Steven A. Reynolds
(74) *Attorney, Agent, or Firm* — Hauptman Ham, LLP

(57) ABSTRACT

In order to achieve both ease of removal and an increase in the rate of impregnation by a predetermined chemical, in this packaging structure of a package of wet wipes, a convex region is formed at a position containing a region that faces the opening of a main package body and that is on the upper surface of a stacked body of wet wipes. The convex region is formed protruding towards the main package body. A space is formed between the region (corresponding to the ends) aside from the convex region formed on the wet wipes and the upper surface to which the opening of the main package body is provided.

5 Claims, 11 Drawing Sheets

(51) Int. Cl.

| | |
|---|---|
| ***B65D 83/08*** | (2006.01) |
| ***B65H 45/24*** | (2006.01) |
| ***B65D 75/58*** | (2006.01) |
| ***B65B 35/50*** | (2006.01) |
| ***B65H 29/24*** | (2006.01) |
| ***B65H 29/32*** | (2006.01) |
| ***B65H 31/30*** | (2006.01) |

(52) U.S. Cl.

CPC ..... *B65D 75/5838* (2013.01); *B65D 83/0894* (2013.01); *B65H 29/242* (2013.01); *B65H 29/32* (2013.01); *B65H 31/3054* (2013.01); *B65H 45/24* (2013.01); *B65H 2301/42262* (2013.01); *B65H 2406/323* (2013.01); *B65H 2701/1321* (2013.01); *B65H 2701/1924* (2013.01)

(56) References Cited

U.S. PATENT DOCUMENTS

| | | | | | |
|---|---|---|---|---|---|
| 4,181,225 | A | * | 1/1980 | Spiegelberg | 206/494 |
| 4,197,964 | A | * | 4/1980 | Pryor | 221/50 |
| 4,221,304 | A | * | 9/1980 | Wahl et al. | 221/1 |
| 4,231,491 | A | * | 11/1980 | Pierson et al. | 221/48 |
| 4,770,320 | A | * | 9/1988 | Miles et al. | 221/33 |
| 5,165,570 | A | * | 11/1992 | Windorski et al. | 221/46 |
| 5,497,903 | A | | 3/1996 | Yoneyama | |
| 5,690,250 | A | * | 11/1997 | Gooding et al. | 221/47 |
| 6,168,848 | B1 | * | 1/2001 | Heath | 428/126 |
| 6,202,889 | B1 | * | 3/2001 | Veith | 221/58 |
| 6,286,713 | B1 | * | 9/2001 | Chan et al. | 221/49 |
| 6,352,172 | B1 | * | 3/2002 | Chan et al. | 221/63 |
| 6,378,726 | B1 | * | 4/2002 | Chan et al. | 221/51 |
| 8,097,326 | B2 | * | 1/2012 | Wunderlich | 428/126 |
| 2002/0060222 | A1 | * | 5/2002 | Bando | 221/48 |
| 2002/0070141 | A1 | * | 6/2002 | Iida | 206/494 |
| 2011/0215110 | A1 | * | 9/2011 | Kadhum et al. | 221/45 |

FOREIGN PATENT DOCUMENTS

| | | | |
|---|---|---|---|
| JP | H07-204118 | A | 8/1995 |
| JP | H07-213453 | A | 8/1995 |
| JP | 3064372 | U | 9/1999 |
| JP | 2007-144053 | A | 6/2007 |
| JP | 2009-096567 | A | 5/2009 |
| WO | 03/037746 | A2 | 5/2003 |
| WO | 2011/001574 | A1 | 1/2011 |

OTHER PUBLICATIONS

Extended European Search Report dated Jun. 26, 2015, corresponding to European patent application No. 11828838.0.

Office Action dated Jul. 24, 2015, corresponding to Taiwanese patent application No. 100135592.

* cited by examiner

PACKAGE STRUCTURE

RELATED APPLICATIONS

The present application is a National Phase of International Application Number PCT/JP2011/071226, filed Sep. 16, 2011, and claims priority from Japanese Application Number 2010-223248, filed Sep. 30, 2010.

TECHNICAL FIELD

The present invention relates to a package structure of wet wipes.

BACKGROUND ART

As a method for manufacturing wet wipes formed of a laminated body of sheets impregnated with a predetermined chemical, there are known methods disclosed in Patent Literatures 1 and 2.

A method disclosed in Patent Literature 1 has: a step of impregnating an original fabric with part of a predetermined chemical during conveyance of the original fabric before lamination; a step of squeezing out an excess of the predetermined chemical impregnated in the original fabric during conveyance of the original fabric; a step of laminating a plurality of original fabrics during conveyance of the original fabrics; and a step of impregnating the original fabrics with the rest of the predetermined chemical during conveyance of the original fabrics after lamination.

Furthermore, a method disclosed in Patent Literature 2 has: a step of impregnating an original fabric with a chemical during conveyance of the original fabric before lamination; a step of laminating the original fabric while folding it back during conveyance of the original fabric; a step of conveying the original fabric after lamination while compressing it in a thickness direction and thereafter cutting the original fabric; and the like.

A package structure of the wet wipes manufactured by the methods disclosed in Patent Literatures 1 and 2 has a configuration of a so-called pop-up type that when one sheet is taken out of a container, the next one is also pulled out together and protruded from an outlet of the container.

CITATION LIST

Patent Literature

Patent Literature 1: Japanese Patent Publication No. H7-204118

Patent Literature 2: Japanese Patent Publication No. 2007-144053

SUMMARY OF INVENTION

However, the applicants found that the pop-up type package structure has room for improvement because if an impregnation rate of a predetermined chemical to an original fabric is increased or weight of the original fabric is increased, the original fabrics are interconnected by means of a water screen of the predetermined chemical, which makes it difficult to take sheets out one by one from a package body packaging a container or laminated body.

Thus, it is an object of the present invention to provide a package structure of wet wipes, which is capable of achieving both increase of the impregnation rate of a predetermined chemical and the easiness of taking sheets out.

A feature of the present invention is summarized as a package structure that contains wet wipes formed of a laminated body of sheets impregnated with a predetermined chemical, inside a package main body, the package structure wherein: the package main body is provided with an opening portion through which the sheets are taken out; in the wet wipes, a convex region protruded toward a surface provided with the opening portion, is formed in a region including a region facing to the opening portion; and in an unopened state in which the opening portion is unopened, a space is formed between the surface provided with the opening portion of the package main body and a region other than the convex region.

BRIEF DESCRIPTION OF DRAWINGS

FIG. 11(*b*) shows results of a taking-out test for a package body in which the entire surface of a laminated body was pressed; and FIG. 11(*c*) shows results of a taking-out test for a package body to which the pressing step was performed by the pressing device according to the embodiment.

DESCRIPTION OF EMBODIMENTS

First Embodiment of Present Invention

Figure 1:
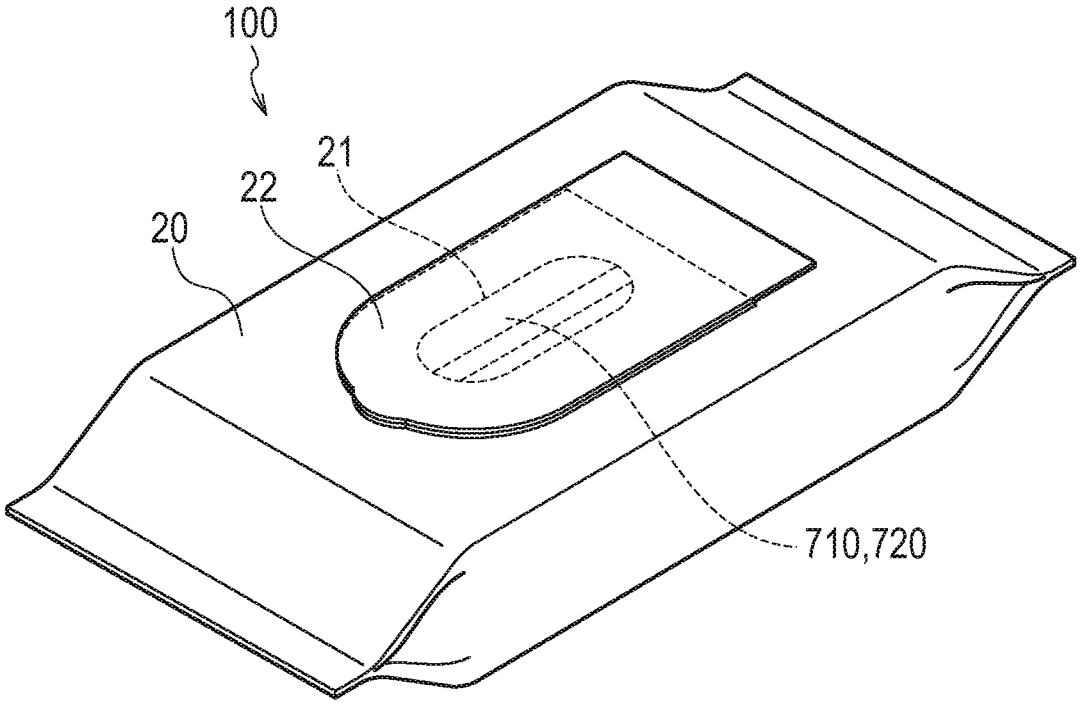
FIG. 1 is a perspective view of a package body of wet wipes according to a first embodiment of the present invention.
Figure 2:
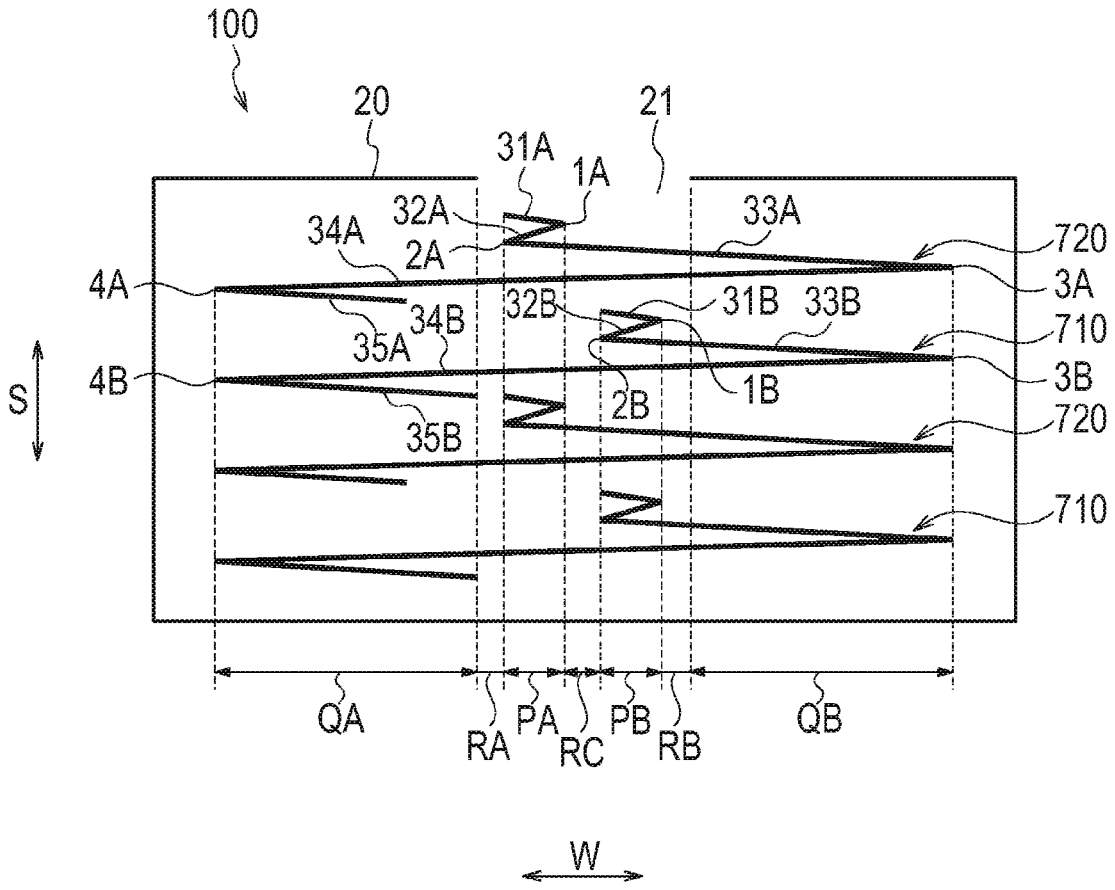
FIG. 2 is a view for showing a state in which the wet wipes according to the first embodiment of the present invention are contained inside the package body.
Figure 3:
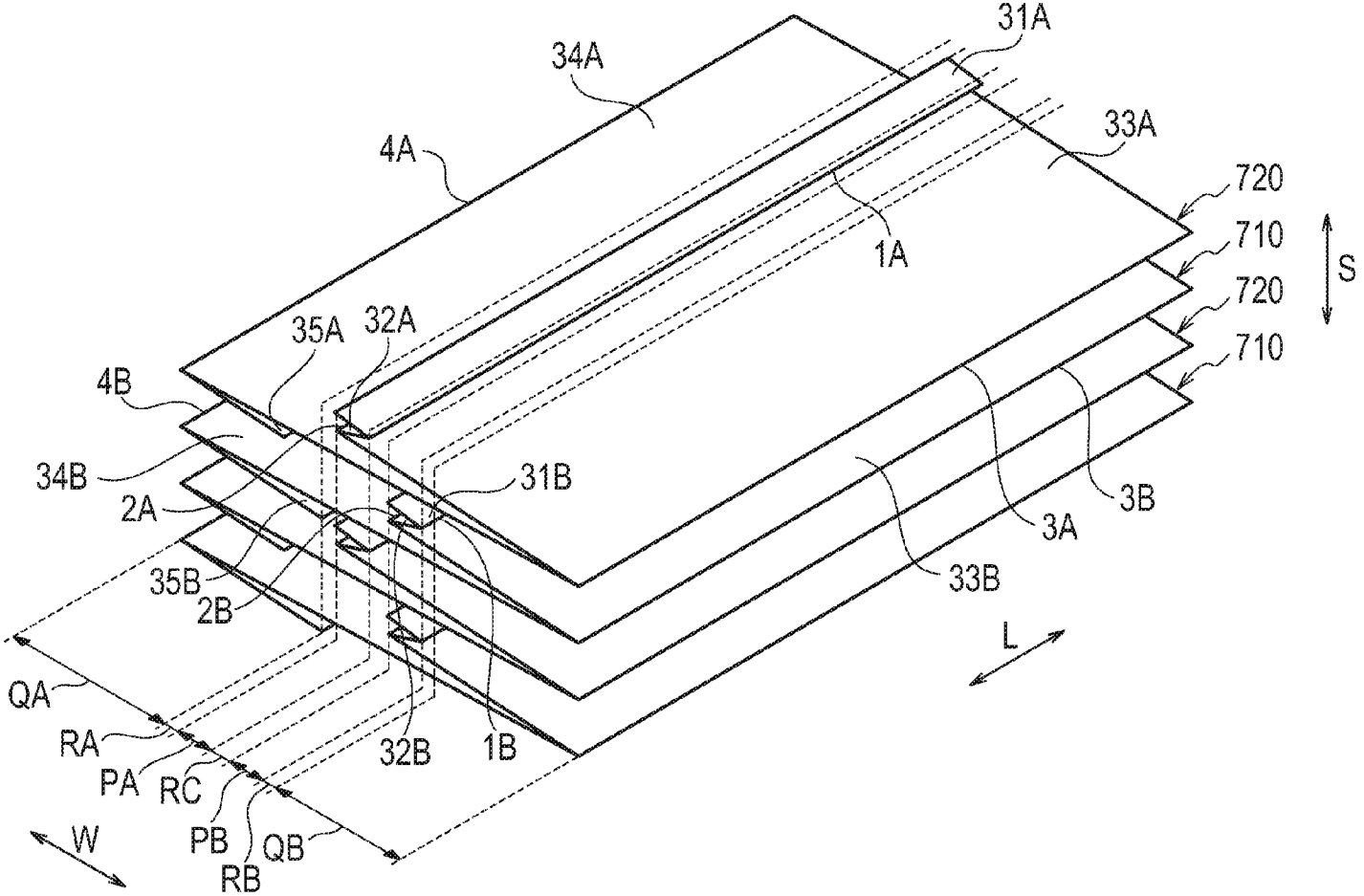
FIG. 3 is a view for showing a state in which the wet wipes according to the first embodiment of the present invention are contained inside the package body.

With reference to FIGS. 1 to 3, wet wipes manufactured by a manufacturing apparatus 10 according to a first embodiment of the present invention are explained. Such wet wipes are formed of a laminated body of sheets 710, 720 impregnated with a predetermined chemical.

As shown in FIG. 1, a package body 100 of the wet wipes has: a package main body 20 having an opening portion 21; a label member 22 attached to the exterior face of the package main body 20 to cover the opening portion 21; and a laminated body 800 (see, FIGS. 4 and 5) of the sheets 710, 720 contained inside the package main body 20.

Each of the sheets 710, 720 is contained inside the package main body 20 in a state where these sheets are folded back as shown in FIGS. 2 and 3.

As shown in FIGS. 2 and 3, the sheet 720 has regions 31A, 32A, 33A, 34A, 35A, whereas the sheet 710 has regions 31B, 32B, 33B, 34B, 35B.

Herein, in the sheet 720, the regions 31A, 32A are folded back along a folding line 1A; the regions 32A, 33A are folded back along a folding line 2A; the regions 33A, 34A are folded back along a folding line 3A; and the regions 34A, 35A are folded back along a folding line 4A.

Similarly, in the sheet 710, the regions 31B, 32B are folded back along a folding line 1B; the regions 32A, 33A are folded back along a folding line 2B; the regions 33A, 34A are folded back along a folding line 3B; and the regions 34A, 35A are folded back along a folding line 4B.

Note that in the sheet 720, the folding lines 1A, 2A are provided between the folding lines 3A, 4A in a widthwise direction W, whereas in the sheet 710, the folding lines 1B, 2B are provided between the folding lines 3B, 4B in the widthwise direction W.

That is, in the sheet 720, a region between the folding lines 1A, 2A in the widthwise direction W has a four-layered structure formed by folding back the regions 31A, 32A, 33A, 34A, whereas the other region has a two-layered structure formed by folding back the regions 33A, 34A.

Therefore, the regions 31A, 32A rise in a lamination direction S of the laminated body while extending in one direction L of the laminated body.

That is, the regions 31A, 32A are folded back along the folding lines 1A, 2A to thereby configure a rising region PA which is formed in the laminated body so as to rise in the lamination direction S while extending in the one direction L.

Similarly, in the sheet 710, a region between the folding lines 1B, 2B in the widthwise direction W has a four-layered structure formed by folding back the regions 31B, 32B, 33B, 34B, whereas the other region has a two-layered structure formed by folding back the regions 33B, 34B.

Therefore, the regions 31B, 32B rise in a lamination direction S of the laminated body while extending in the one direction L of the laminated body.

That is, the regions 31B, 32B are folded back along the folding lines 1B, 2B to thereby configure a rising region PB which is formed in the laminated body so as to rise in the lamination direction S while extending in the longitudinal direction L.

Furthermore, one region (that is, the rising region PA) between the folding lines 1A, 2A in the widthwise direction W is arranged so as not to be overlapped with the other region (that is, the rising region PB) between the folding lines 1B, 2B in the direction W.

Furthermore, in the rising regions PA, PB, the sheets 710, 720 adjacent to each other in the lamination direction S are laminated in close contact with each other with a predetermined chemical intervened therebetween.

Herein, in regions RA, RB, RC adjacent to the rising regions PA, PB, since a gap is formed between the sheets 710, 720 adjacent to each other in the lamination direction S, these sheets are not laminated in close contact with each other with the predetermined chemical intervened therebetween.

Note that the wet wipes manufactured with the manufacturing apparatus 10 according to the first embodiment of the present invention are not configured as the aforementioned pop-up type. Therefore, even in a case where the sheet 720 is taken out through the opening portion 21 of the package main body 20, the sheet 710 is not pulled up together to be protruded from the opening portion 21.

That is, after taking out the sheet 720 through the opening portion 21 of the package main body 20 by grabbing and pulling up the regions 31A, 32A (that is, the rising region PA of the sheet 720), a user can take out the sheet 710 by grabbing and pulling up the regions 31B, 32B (that is, the rising region PB of the sheet 710).

Figure 4:
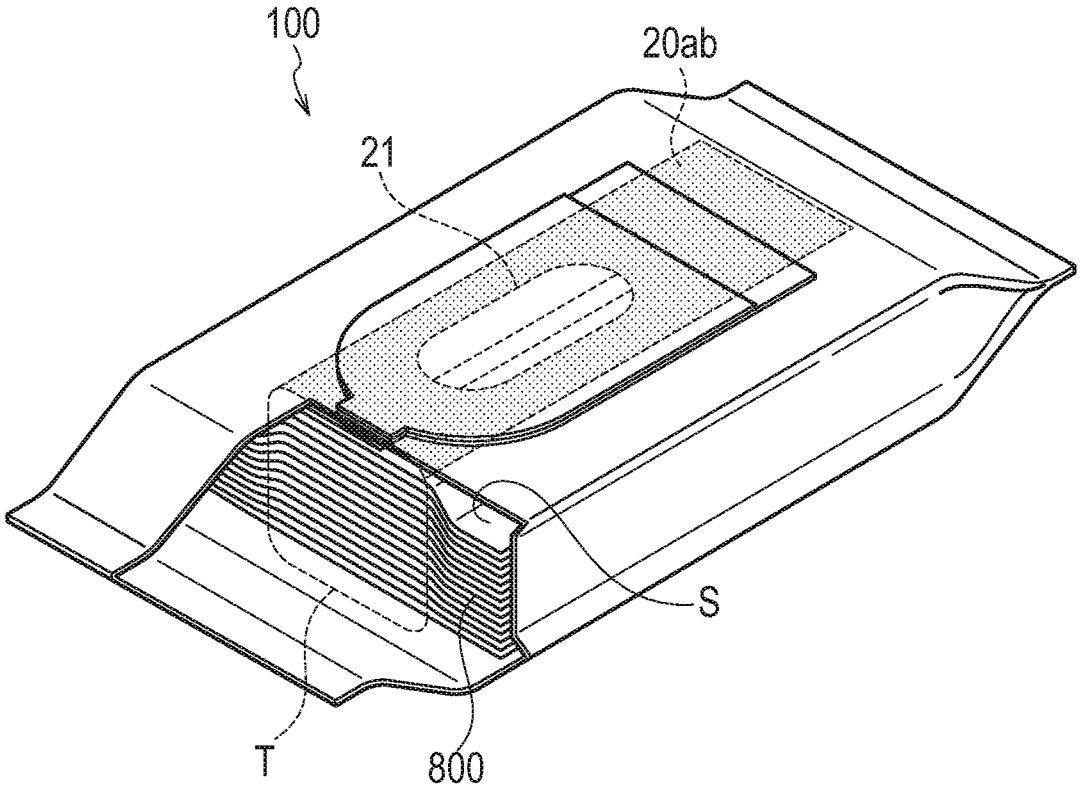
FIG. 4 is a perspective view for illustrating a package structure of the wet wipes according to the first embodiment of the present invention.
Figure 5:
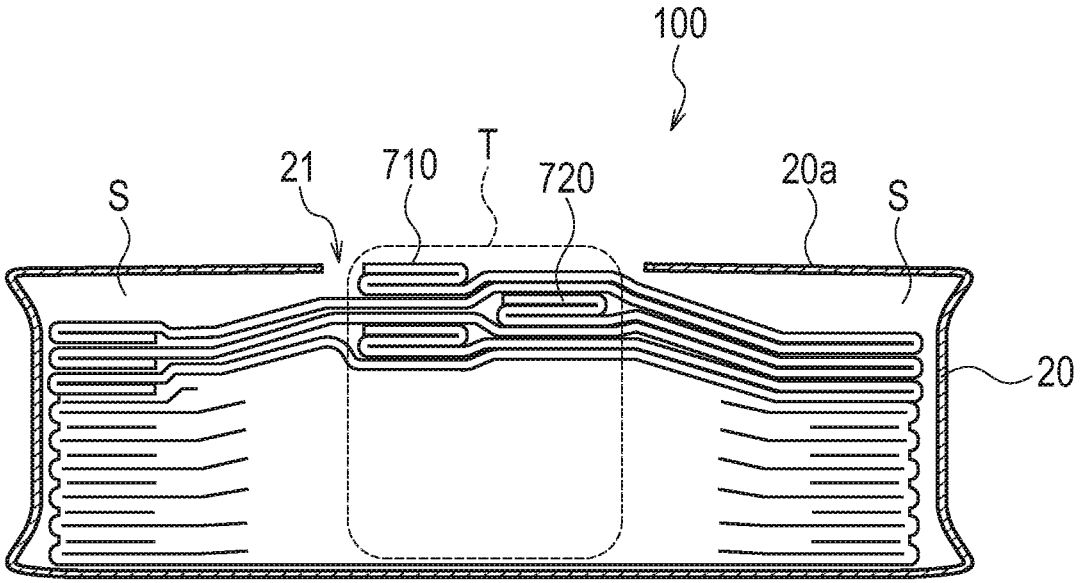
FIG. 5 is a cross-sectional view for illustrating the package structure of the wet wipes according to the first embodiment of the present invention.

As shown in FIGS. 4 and 5, a package structure of the package body 100 is configured as follows. A convex region T is formed in a position including a region facing to the opening portion 21 of the package main body 20 at the upper face side of the laminated body 800 of wet wipes. The convex region T is formed so as to be protruded toward the package main body 20. The convex region T corresponds to a central region 800C to be described later.

In an unopened state in which the opening portion is unopened, a space S is formed between an upper surface 20*a* provided with the opening portion 21 of the package main body 20 and a region (corresponding to end portions 800A, 800B to be described later) other than the convex region T formed in wet wipes.

Herein, the "unopened state" includes a state in which the package body 100 is on sale. This state also includes a state before the label member 22 is first removed to open by a user. Furthermore, even after the user removes the label member 22, a state before the sheets 710, 720 are taken out from the inside of the package main body 20 is included in the "unopened state". Yet further, a state after the predetermined number of sheets 710, 720 are taken out is also included in the "unopened state".

The "unopened state" also includes a state in which a thickness of the convex region T of the laminated body 800 contained inside the package main body 20 is approximately equal to a length of the package main body 20 corresponding to a lamination direction of the sheets 710, 720.

The convex region T extends in a longitudinal direction L or short direction (that is, a widthwise direction W) of the package body 100 of wet wipes. In the package structure of the package body 100 of wet wipes according to the present embodiment, the convex region T extends in the longitudinal direction L and comes in contact with a partial region 20*ab* other than the opening portion 21 of the package main body 20 (see, FIG. 4).

Figure 7:
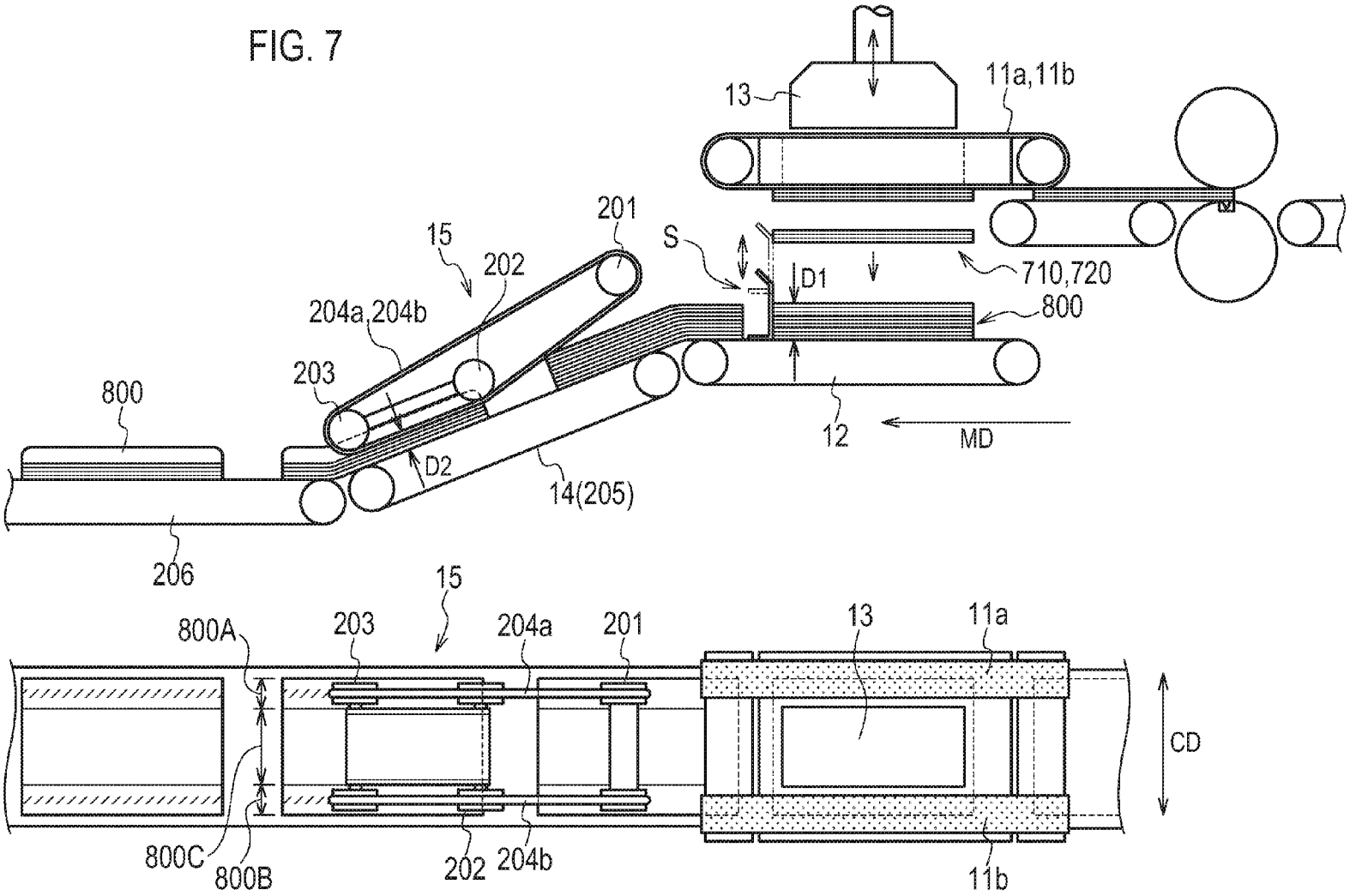
FIG. 7 is a view for illustrating a device used in a laminating step and a pressing step of the manufacturing apparatus for manufacturing the package structure according to the first embodiment of the present invention.
Figure 8:
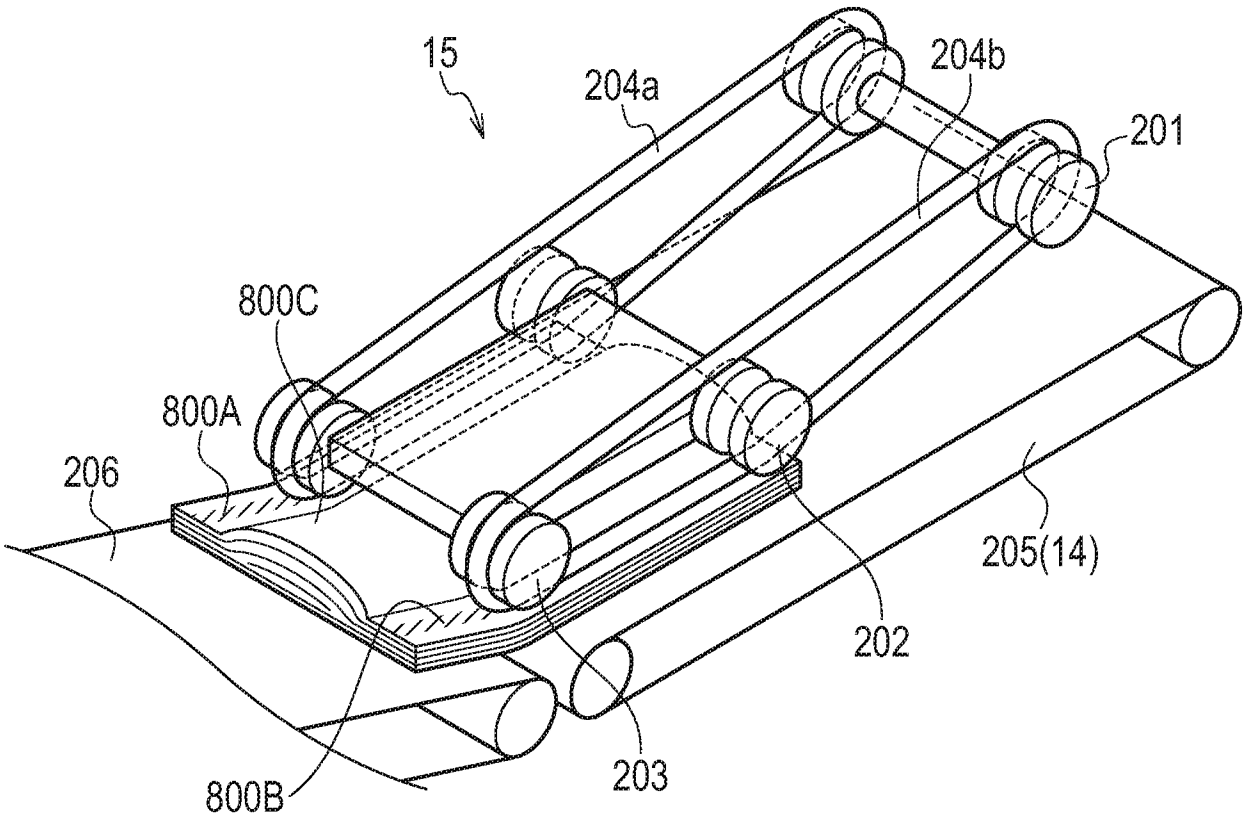
FIG. 8 is a view for illustrating a configuration of a pressing device for manufacturing the package structure according to the first embodiment of the present invention.

Hereinafter, with reference to FIGS. 6 to 8, a manufacturing method for realizing the package structure of wet wipes according to the present embodiment is briefly explained.

Figure 6:
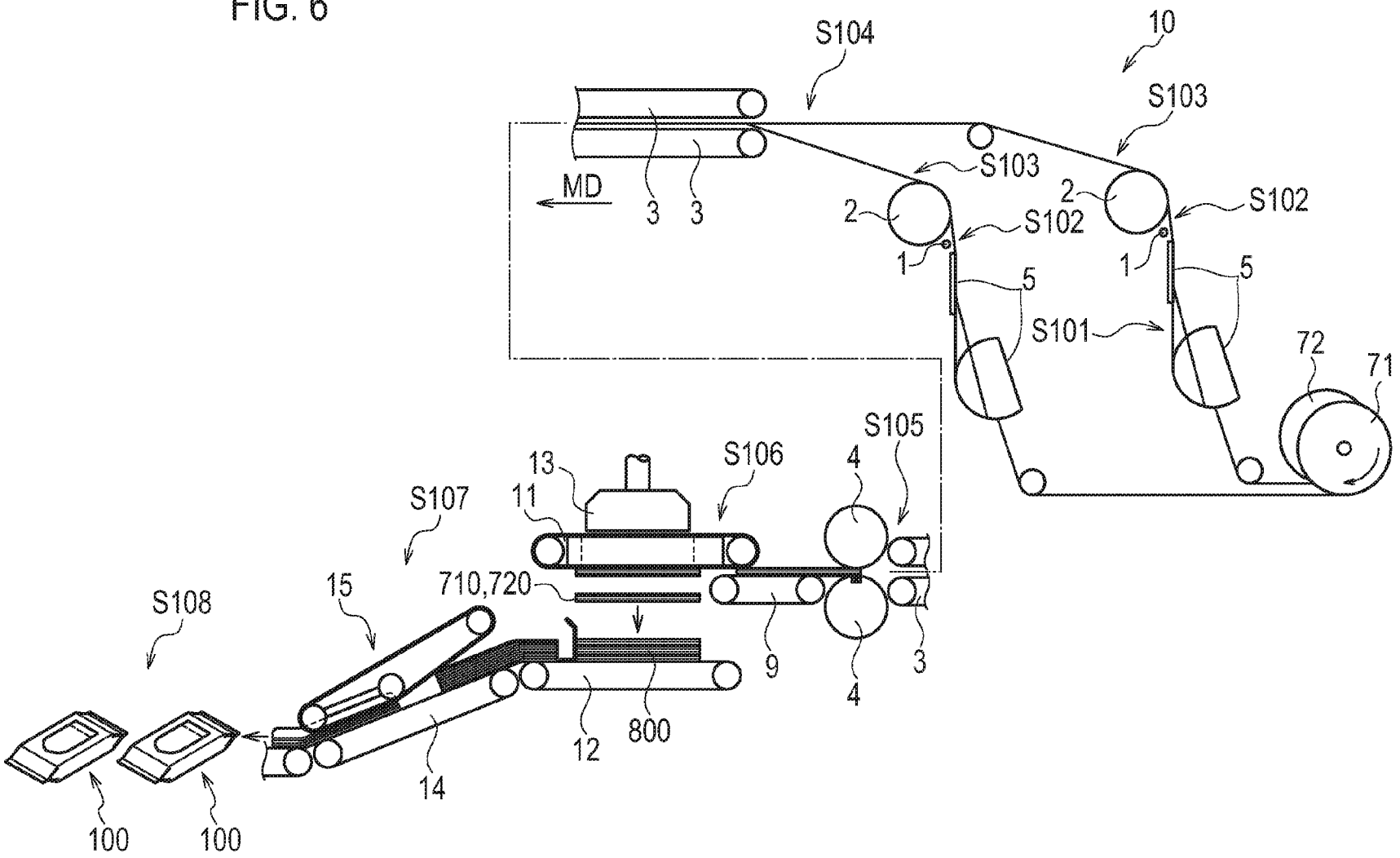
FIG. 6 is a schematic view of a manufacturing apparatus for manufacturing the package structure according to the first embodiment of the present invention.

As shown in FIG. 6, in step S101, the folding unit 5 folds respective sheets 71, 72 having been sent out from a wound state in a roller shape, into a predetermined shape (specifically, a shape shown in FIGS. 2 and 3) on a side not in contact with a conveyance device.

For example, the sheets 71, 72 have a basis weight of 25 $g/m^2$ to 100 $g/m^2$, and are made of; fibers made of a hydrophilic fiber such as rayon, cotton, or pulp, and a simple substance such as PET, PP, PE, or acrylic; or hydrophobic composite fibers having a sheath-core structure or a side-by-side structure.

Furthermore, the sheets 71, 72 are a nonwoven fabric shaped in a sheet-like form by a spun lace method, an air-laid method, a direct spinning method, or the like, and these sheets are required to include a hydrophilic fiber in terms of permeability of the predetermined chemical at the time of impregnation of the predetermined chemical.

In step S102, an impregnating unit 1 impregnates each of the folded sheets 71, 72 with a predetermined amount of predetermined chemical from a side in contact with the conveyance device (a side of a conveyance roller 2).

In step S103, each of the sheets 71, 72 impregnated with the predetermined chemical is conveyed in contact with the surface of the conveyance roller 2.

In step S104, a conveyer 3 laminates each of the sheets 71, 72 impregnated with the predetermined chemical.

Specifically, with the conveyer 3, the sheet 72 with its surface impregnated with the predetermined chemical being faced to the side in contact with the conveyance device is laminated from the side not in contact with the conveyance device, on the sheet 71 with its surface impregnated with the predetermined chemical being faced to the side in contact with the conveyance device.

In step S105, a cutting unit 4 cuts the sheets 71, 72 conveyed by the conveyer 3, into the sheets 710, 720 with a predetermined size.

Thereafter, after a laminated body 800 formed by laminating a predetermined number of the cut-out sheets 710, 720 is obtained in laminating step S106, the laminated body 800 is conveyed in pressing step S107 while both outer end portions in the widthwise direction of the laminated body 800 formed of the cut-out sheets 710, 720 are pressed from a side not in contact with the conveyer 14. In packaging step S108, the laminated body 800 is packaged in the package main body 20.

Hereinafter, with reference to FIGS. 6 to 8, each function of the manufacturing apparatus 10 according to the present embodiment is explained.

As shown in FIG. 4, the manufacturing apparatus 10 has: the folding unit 5; the impregnating unit 1; the conveyance roller 2; conveyors 3, 9, 11, 12; the cutting unit 4; the pusher 13; and a pressing device 15. Herein, in the manufacturing apparatus 10, the conveyance roller 2 and the conveyors 3, 9 make up a conveyance device configured to continuously convey the plurality of sheets 71, 72. Furthermore, the conveyers 11, 12, 14 make up a conveyance device configured to continuously convey the sheet bundles 800.

The folding unit 5 is configured to fold back each of the sheets 71, 72 on a side not in contact with the conveyance device. Specifically, the folding unit 5 is configured to fold back each of the sheets 71, 72 so that the sheets 71, 72 are formed in a shape shown in FIGS. 2 and 3.

Specifically, the folding unit 5 is configured so that: the regions 31A, 32A, 33A (or 31B, 32B, 33B) including one side edge of the sheet 72 (or 71) are folded back on a side not in contact with the conveyance device, along the folding line 3A (or 3B) in the conveyance direction MD; thereafter the regions 31A, 32A (or 31B, 32B) including one side edge of the sheet 72 (or 71) are folded back on the side not in contact with the conveyance device, along the folding line 2A (or 2B) in the conveyance direction MD; and thereafter, the region 31A (or 31B) including one side edge of the sheet 72 (or 71) is folded back on the side not in contact with the conveyance device, along the folding line 1A (or 1B) in the conveyance direction MD.

Furthermore, the folding unit 5 is configured so that the region 35A (or 35B) including the other side edge of the sheet 72 (or 71) is folded back on a side in contact with the conveyance device, along the folding line 4A (or 4B) in the conveyance direction MD.

The impregnating unit 1 is configured to impregnate each of the folded sheets 71, 72 with the predetermined chemical, from the side in contact with the conveyance device.

For example, the impregnating unit 1 may be configured to push out the predetermined chemical by a predetermined amount from a chemical tank by using a proportioning pump. As a result, the predetermined amount of predetermined chemical is discharged from a pore provided in the impregnating unit 1 and comes in contact with the sheets 71, 72, so that each of the sheets 71, 72 is impregnated with the predetermined amount of predetermined chemical.

Furthermore, the impregnating unit 1 may be configured to impregnate the sheets 71, 72 with the predetermined chemical having weight of 3.5 (between 3 and 4) times heavier than the sheets 71, 72, for example.

Note that a weight rate (that is, an impregnation rate) of the predetermined chemical to be impregnated, with respect to the sheets 71, 72 is appropriately adjustable by the impregnating unit 1.

Herein, an impregnation rate required for the sheets 71, 72 to adhere to the surface of the conveyance roller 2 and for the sheet 72 to adhere to the top of the sheet 71 is 1.5 times or more in a case of using as the sheets 71, 72, a spun lace nonwoven fabric of 38 $g/m^2$ having a rayon fiber as a main constituent, for example.

Furthermore, as a method for applying a predetermined chemical, the impregnating unit 1 may adopt a method for attaching a predetermined chemical in a droplet form or in a mist form to the sheets 71, 72. However, the above-described method is preferable in consideration of impregnation efficiency and process pollution of chemical at the time when surfaces of the sheets 71, 72, which are impregnated with the predetermined chemical, are brought in contact with the surface of the conveyance roller 2.

The conveyance roller 2 is connected to a driving source and is a driving roller with a smooth surface, configured to rotate by itself.

The conveyor 3 is configured to convey each of the sheets 71, 72 at an approximately equal conveyance speed to the conveyance roller 2.

The cutting unit 4 is configured to cut the laminated body formed by laminating the plurality of sheets 71, 72 in a state where the sheets 71, 72 impregnated with the predetermined chemical are folded back. For example, the cutting unit 4 is configured so that a cutter roller having a cutting blade on its surface and an anvil roller having a smooth surface cut the plurality of continuously-conveyed sheets at a predetermined interval in a direction perpendicular to the conveyance direction.

Furthermore, like the conveyor 3, the conveyor 9 may be provided at both the upside and downside. In such a case, the laminated body of the sheets 710, 720 is conveyed while being sandwiched between an upper conveyer arranged at the upside and a lower conveyer arranged at the downside. This upper conveyor may be provided with a concave portion and a convex portion.

As a result, the laminated body of the sheets 710, 720 after being cut by the cutting unit 4 is improved in its transfer ability and conveyance stability with respect to the conveyer 9.

Herein, a conveyance speed of the conveyor 9 is 3% higher than the conveyor 3 and the cutting unit 4.

The conveyer 11 has conveyers 11*a*, 11*b* arranged at a predetermined interval in a cross direction CD intersecting with the conveyance direction MD. The conveyers 11*a*, 11*b* are provided with a suction mechanism (not shown) to enable the cut-out sheets 710, 720 conveyed by the conveyer 9 to be conveyed with their outer ends in the widthwise direction being adsorbed to the conveyance surface. The pusher 13 is arranged between the conveyers 11*a*, 11*b*.

The pusher 13 is arranged movably in a direction of pushing down the sheets 710, 720 conveyed by the conveyer 11, that is, in a direction of detaching the sheets 710, 720 from the conveyance surfaces of the conveyers 11*a*, 11*b*.

After the laminated body 800 is formed by laminating the predetermined number of sheets 710, 720 detached from the conveyers 11*a*, 11*b*, a stopper S is released and the laminated body 800 is conveyed by the conveyer 12 toward the pressing device 15.

The pressing device 15 is configured so that the laminated body 800 formed by laminating the cut-out sheets 710, 720 is conveyed while both end portions in the conveyance direction of the laminated body 800 are pressed by a pressing portion from a side not in contact with the conveyer 14.

The pressing device 15 has a plurality of rollers 201, 202, 203; press belts 204*a*, 204*b* wound around the plurality of rollers 201, 202, 203; and conveyance belts 205, 206 for conveying the laminated body 800.

Any one of the plural rollers 201, 202, 203 is connected to a driving source and controlled so as to drive the press belts 204*a*, 204*b* at a predetermined speed in the conveyance direction. The conveyance belt 205 corresponds to the conveyance belt 14.

The press belts 204*a*, 204*b* are wound around the rollers 201, 202, 203 and configured to be driven in association with the conveyance speed and the conveyance direction of the laminated body 800. The press belts 204*a*, 204*b* are arranged to be interspaced from each other at a predetermined interval in the cross direction CD intersecting with the conveyance direction MD. Herein, the predetermined interval is an interval that allows the press belts 204*a*, 204*b* to come in contact with both end portions 800A, 800B in the cross direction CD of the laminated body 800.

The press belts 204*a*, 204*b* according to the present embodiment are formed in a round tubular shape. That is, the press belts 204, 204*b* have a cross section in a substantially circular shape.

Interval D2 between the outermost periphery of the press belts 204*a*, 204*b* wound around the rollers 201, 202, 203, the outer most periphery which is most distant from the rotation axes of the rollers 201, 202, 203, and the conveyance surface of the conveyance belt 205 is made shorter than lamination height D1 of the laminated body 800. The interval D2 is adjusted to a height that the chemical is prevented from being squeezed out more than necessary.

The press belts 204*a*, 204*b* are inclined so as to gradually decrease the interval from D1 to D2, between the outermost periphery of the press belts 204*a*, 204*b* and the conveyance belt 205. Accordingly, a force is gradually applied to the both outer end portions 800A, 800B in the widthwise direction of the laminated body 800 to be conveyed.

With the manufacturing method and the manufacturing apparatus 10 according to the present embodiment, by means of the pressing device 15 configured as described above, the laminated body 800 can be conveyed while pressing the both end portions 800A, 800B, other than a central region 800C, of the laminated body 800.

Figure 10:
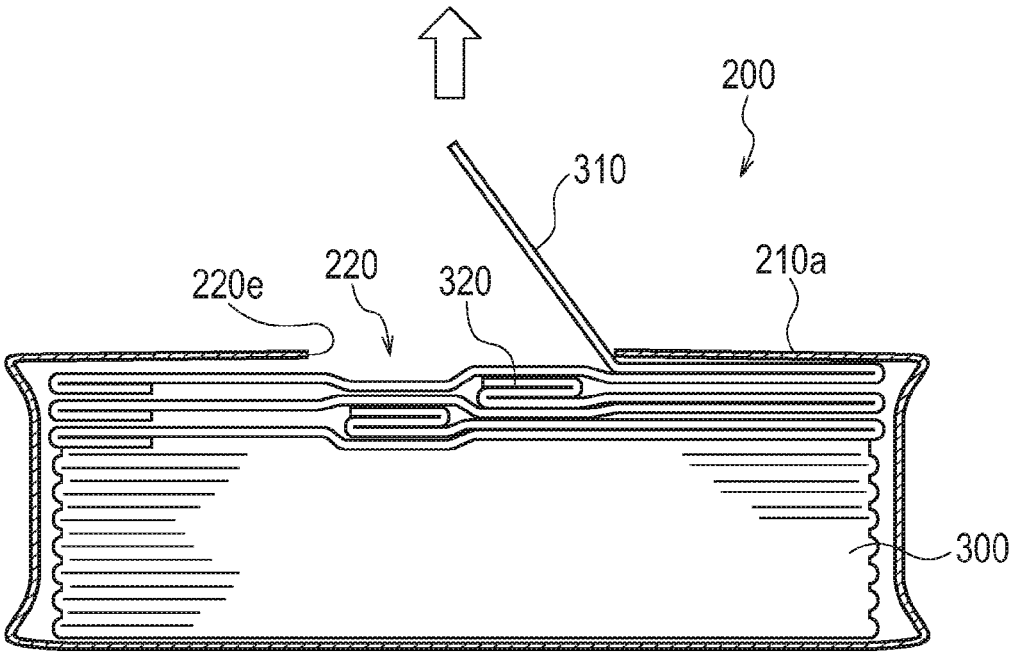
FIG. 10 PRIOR ART
FIG. 10 is a simplified view for illustrating a state in which a sheet is taken out in a conventional package structure.

FIG. 10 is a view for illustrating a package structure 200 of a conventional laminated body 300 the entire surface of which was pressed at the time of packaging in a package main body 210. With a conventional package structure 200, in an early stage of usage, when a sheet 310 is taken out of an opening portion 220 of the package main body 210, the sheet 310 is regulated by an edge portion 220*e* while being pressed by an upper surface 210*a* of the package main body 210, and therefore, it could happen that the sheet 310 becomes difficult to be taken out or the sheets 310, 320 are taken out all stuck together.

To solve the problems described above, it is contemplated that the package main body 210 is made larger as compared to a volume of the laminated body 300.

However, if a configuration is made to expand a gap between the package main body 210 and the laminated body 300 for the purpose of the easiness of taking sheets out at the beginning of usage, raw materials as ingredients of the package main body become a waste, leading to increase in manufacturing costs. Furthermore, it also gives an impression to a consumer (user) that the package body and its contents (sheets) do not fit each other, thereby leading to deterioration in an appearance and reliability of the package body as a product.

Furthermore, a too-large gap between the package main body 210 and the laminated body 300 may cause a problem that it becomes difficult to laminate package bodies each other or there is increased volume when the plurality of package bodies are packaged all together.

On the other hand, in the manufacturing structure according to the present embodiment, in the manufacturing step, after the laminating step S107, the laminated body 800 formed by laminating the predetermined number of sheets is pressed not by uniformly pressing its entire surface but pressing the both end portions 800A, 800B in the conveyance direction by the pressing device 15.

Figure 9:
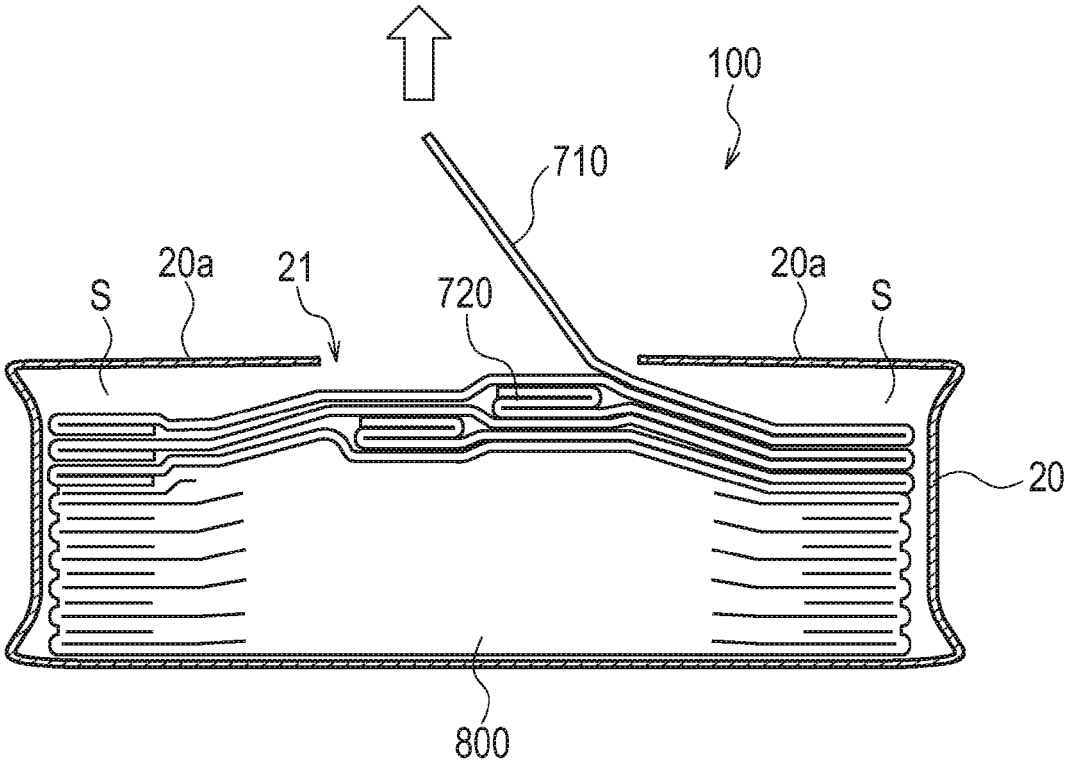
FIG. 9 is a simplified view for illustrating a state in which a sheet is taken out in the package structure according to the first embodiment of the present invention.

Accordingly, as shown in FIG. 9, a space S can be formed between the upper surface 20*a* of the package main body 20 and the outer end portions 800A, 800B in the widthwise direction of the laminated body 800. Therefore, even in a case of formation that is made to adjust a size of the package main body 20 to a volume of the laminated body 800, it is possible to prevent a problem caused by the fact that a sheet positioned in the upper surface side of the laminated body 800 is pressed by the upper surface 20*a* of the package main body 20. Especially in an early stage of usage, a plurality of sheets can be prevented from being taken out all stuck together from the opening portion 21.

Furthermore, in the package structure according to the present embodiment, since the surface of the laminated body 800 is not entirely pressed, it is possible to prevent variability in an impregnation amount which is caused by the fact that the chemical is shifted from sheets in the upper layer to sheets in the lower layer of the laminated body 800.

With the package structure according to the present embodiment, it is possible to prevent reduction in the easiness of taking sheets out, which is caused by increasing an amount of a predetermined chemical impregnated in sheets. Thus, it is possible to achieve both increase of the impregnation rate of a predetermined chemical and the easiness of taking sheets out.

Thus, the present invention has been explained in detail by using the above-described embodiments; however, it is obvious that for persons skilled in the art, the present invention is not limited to the embodiments explained herein. The present invention can be implemented as corrected and modified modes without departing from the gist and the scope of the present invention defined by the claims. Therefore, the description of the specification is intended for explaining the example only and does not impose any limited meaning to the present invention.

For example, with respect to the package structure of the package body 100 of wet wipes according to the present embodiment, it was explained that the convex region T extends in the longitudinal direction L. However, the convex region T may extend in the widthwise direction W. In this case, the convex region T comes in contact with the upper surface 20*a* of the package main body 20 at both sides in the widthwise direction W of the opening portion 21.

EXAMPLES

Figure 11:
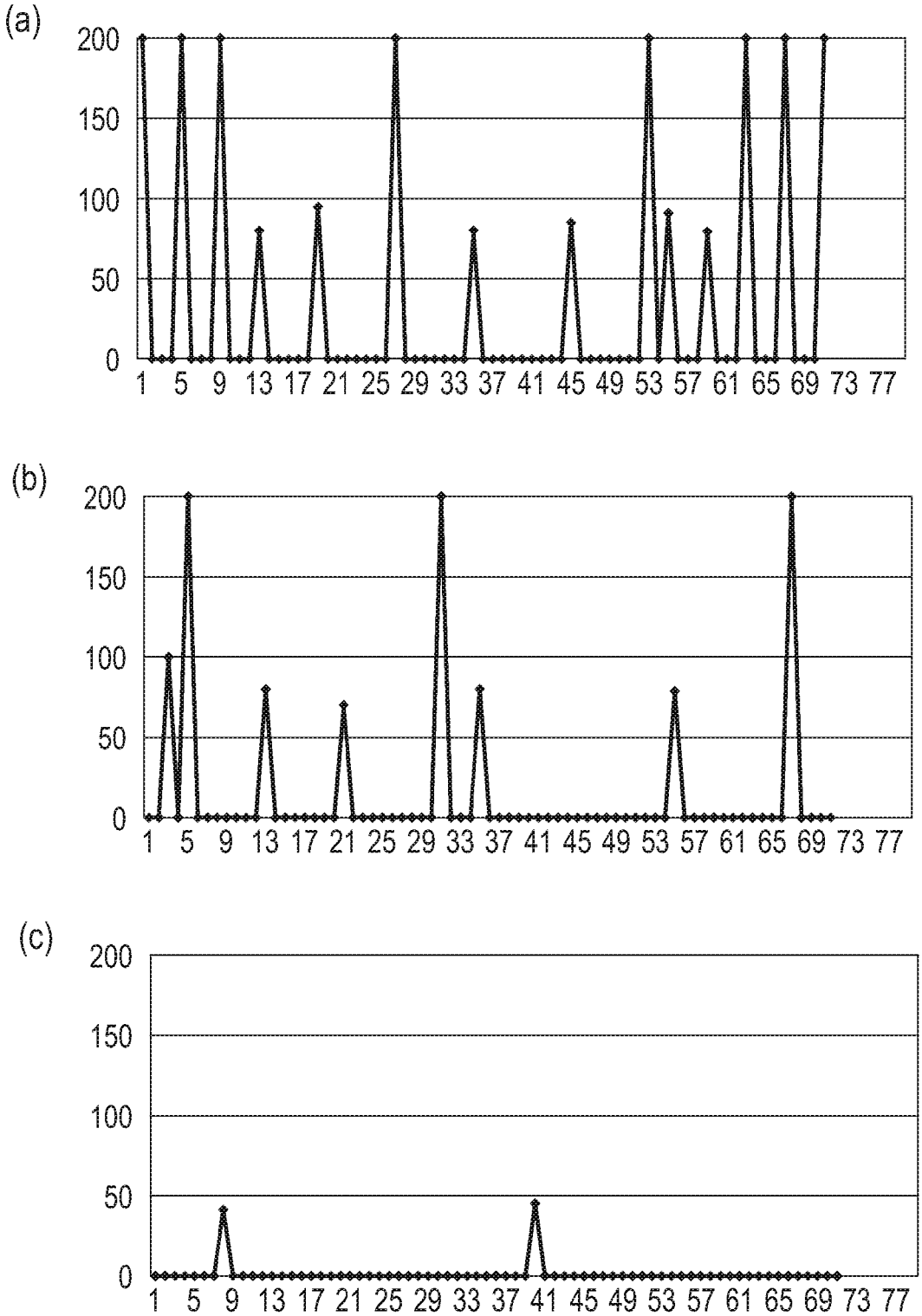
FIG. 11(*a*) shows results of a taking-out test for a package body to which the pressing step was not performed by the pressing device.

A take-out test was performed by packaging the laminated body formed of seventy-two sheets in the package main body and taking sheets out one by one. The results are shown in FIGS. 11(*a*) to 11(*c*). Specifically, a manufacturing line that one set was formed by stacking four sheets was made. That is, the laminated body formed of eighteen sets was produced and sealed in the package body.

FIG. 11(*a*) shows the results of a take-out test performed to the package structure to which the pressing step was not performed. FIG. 11(*b*) shows the results of a take-out test performed to the package structure in which the entire surface was pressed. FIG. 11(*c*) shows the results of a take-out performed to the package structure in which the pressing step was performed to both ends of the laminated body. In FIGS. 11(*a*) to 11(*c*), the vertical axis shows the amount of a pulled-out portion of subsequent sheet in the event of pop-up (a phenomenon that a subsequent sheet is pulled out in association with a prior sheet). A portion is length (mm).

According to the results, it turned out that the laminated body to which the pressing step was not performed has a strong tendency that four sheets are taken out at one time. That is, it turned out that one set of sheets stacked in the manufacturing line is prone to be taken out all stuck together. Furthermore, it turned out that even in a case of a laminated body with its entire surface being pressed, one set of sheets stacked in the manufacturing line is prone to be taken out all together.

On the other hand, it turned out that the laminated body having the package structure according to the embodiment hardly causes the pop-up and has a strong tendency that all of sheets can be taken out one by one.

In addition, the entire content of Japanese Patent Application No. 2010-223248 (filed on Sep. 30, 2010) is incorporated in the present specification by reference.

INDUSTRIAL APPLICABILITY

According to the present invention, it is possible to provide a package structure of wet wipes, which is capable of achieving both increase of the impregnation rate of a predetermined chemical and the easiness of taking sheets out.

The invention claimed is:

1. A package structure, comprising a package main body; and stack of sheets impregnated with a predetermined chemical to form wet wipes, and arranged in a stacking direction inside the package main body, wherein the package main body has a surface provided with an opening portion configured for the sheets to be taken out each of the sheets has a convex region facing the opening portion and protruding toward the surface provided with the opening portion in an unopened state in which the opening portion is unopened, a space is formed between the surface provided with the opening portion of the package main body and a region other than the convex region of a topmost sheet, each of the sheets is folded back along a first folding line, a second folding line, a third folding line and a fourth folding line, in a widthwise direction of each of the folded sheets, the first folding line and the second folding line are located between the third folding line and the fourth folding line, in each of the folded sheets, a region between the first folding line and the second folding line in the widthwise direction has a four-layered structure in the stacking direction, and other regions of the folded sheet have a two-layered structure in the stacking direction, and for each pair of adjacent folded sheets among the folded sheets, the region between the first folding line and the second folding line in the widthwise direction in one of the adjacent folded sheets does not overlap the region between the first folding line and the second folding line in the widthwise direction in the other of the adjacent folded sheets in the stacking direction.

2. The package structure according to claim 1, wherein the folded sheets are stacked in a rectangular form in which each of the folded sheets has a long side and a short side; and the convex region of each of the folded sheets extends along the long side or the short side.

3. The package structure according to claim 1, wherein the convex region is in contact with the surface of the package main body in a region other than the opening portion of the surface.

4. The package structure according to claim 1, wherein each of the folded sheets has two outer end regions; and the convex region between the two outer end regions in the widthwise direction, and the convex region includes the four-layered structure, and the two outer end regions include the corresponding two-layered structure.

5. The package structure according to claim 4, wherein, in each of the folded sheets, the convex region is closer to the opening than the two outer end regions in the stacking direction.

* * * * *